US007559995B2

(12) United States Patent
Edenhofer

(10) Patent No.: US 7,559,995 B2
(45) Date of Patent: Jul. 14, 2009

(54) METHOD FOR HEAT TREATMENT OF METAL WORKPIECES AS WELL AS A HEAT-TREATED WORKPIECE

(75) Inventor: Bernd Edenhofer, Kleve (DE)

(73) Assignee: Ipsen International GmbH (DE)

( * ) Notice: Subject to any disclaimer, the term of this patent is extended or adjusted under 35 U.S.C. 154(b) by 830 days.

(21) Appl. No.: 10/328,555

(22) Filed: Dec. 23, 2002

(65) Prior Publication Data

US 2003/0145907 A1 Aug. 7, 2003

(30) Foreign Application Priority Data

Feb. 4, 2002 (EP) ..... 02002530

(51) Int. Cl.
*C23C 8/34* (2006.01)

(52) U.S. Cl. ..... 148/225; 148/226; 148/227; 148/228; 148/229; 148/230; 148/231; 148/232; 148/233; 148/234; 148/235; 148/236; 148/237

(58) Field of Classification Search ..... 148/225–237
See application file for complete search history.

(56) References Cited

U.S. PATENT DOCUMENTS 4,012,238 A * 3/1977 Scales ..... 148/217
4,806,175 A 2/1989 Wendt

FOREIGN PATENT DOCUMENTS

EP 1 078 996 2/2001

OTHER PUBLICATIONS

Patent Abstracts of Japan, JP 08 144039, Published Jun. 4, 1996.
Chemical Abstracts Service, Takao Kondo et al: "Surface Harding Treatment" XP002204293, PN: JP49030620, published Aug. 14, 1974.
Patent Abstracts O F Japan, JP 62 127459, Published Jun. 9, 1987.
Patent Abstracts O F Japan, JP 03 039460, Published Feb. 20, 1991.
Patent Abstracts O F Japan, JP 02 298251, Published Dec. 10, 1990.
O.H. Kessler et al, Combinations of Coating and Heat Treating Processes: Establishing a System for Combined Processes and Examples, 1998 Elsevier Science S.A., pp. 211-216.
T. Bell et al, "Realising the Potential of Duplex Surface Engineering" Tribology International vol. 31 Nos. 1-3 1998, pp. 127-137.

* cited by examiner

*Primary Examiner*—Sikyin Ip
(74) *Attorney, Agent, or Firm*—Cantor Colburn LLP

(57) ABSTRACT

A process for heat treating metal workpieces contains with respect to an efficient process control the following successive operations following directly one after the other: a heating phase; an enrichment phase; a first cooling phase; a bonding phase; a second cooling phase; and a concluding quenching phase. Workpieces processed by a method of this type are distinguished by a comparatively great fatigue limit and fatigue strength with simultaneous high resistance to wear and tear.

12 Claims, 4 Drawing Sheets

METHOD FOR HEAT TREATMENT OF METAL WORKPIECES AS WELL AS A HEAT-TREATED WORKPIECE

FIELD OF THE INVENTION

The invention concerns a method for the heat treatment of metal workpieces, especially for the combined carburization, boriding and hardening of ferrous products. It furthermore relates to a device by means of which such a method can be implemented, and a workpiece heat-treated using the method.

DESCRIPTION OF THE RELATED ART

For generating defined workpiece properties, such as perhaps a great hardness or resistance to wear and tear, metal workpieces are usually subjected to thermochemical heat treatment. The goal of this heat treatment is, for example, with case-hardening, first of all to carburize the edge layer of the workpiece, i.e. to strengthen it with carbon, in order to bestow a comparatively high degree of hardness upon the workpieces on the basis of the altered material composition resulting therefrom through subsequent hardening. Furthermore, heat treatments where the surface of the workpieces is coated with a layer creating the desired mechanical characteristics are known. Thus, in boriding with the diffusion of boron, a hard boride layer is created on the surface of the workpiece, which leads to a high resistance to wear and tear and resistance to corrosion of the workpieces.

A compilation of the most varied types of heat treatment is found, for example, in DIN 8580. Moreover, methods are known in the state of the art which combine individual types of heat treatment with one another. These so-called combination, hybrid or duplex methods make use of synergy effects, which arise with a combination of various types of heat treatment (cf. O. H. Kessler et al.: "Combinations of coating and heat treating processes: Establishing a system for combined processes and examples," Surface and Coatings Technology 108-109 (1988), pages 211 to 216; T. Bell et al., "Realizing the potential of duplex surface engineering," Tribology International, Volume 31, Number 1-3 (1998), pages 127 to 137). In this way, it is possible to bestow characteristics upon workpieces that could not be attained by the individual types of heat treatment. The workpieces can consequently meet complex standards which, for example, require a great fatigue strength as well as a high resistance to wear and tear as well as to corrosion.

But not every arbitrary combination of various types of heat treatment gives rise to a synergistic result, as Bell et al. point out (op. cit., page 128). In contrast, for example, the combination of CVD (chemical vapor deposition) and quench hardening has a positive action with regard to workpieces provided with a hard surface. For, as Kessler et al. (op. cit.) explain, the surface layer generated with such a duplex process through the plasma-activated vapor deposition process has a great hardness.

SUMMARY OF THE INVENTION

The invention is based upon the objective of creating a process and a device for heat-treating metal workpieces, by means of which a comparatively great hardness, especially fatigue limit and fatigue strength can be attained, with simultaneous high resistance against wear and tear of the workpiece.

For accomplishing this objective, a process for the heat treatment of metal workpieces, especially for combined the carburizing, bonding and hardening of ferrous products, contains the following operations:

a) Heating the workpieces to a first temperature under a vacuum or a neutral or reducing gas atmosphere during a heating phase;

b) Carburizing the workpieces at the initial temperature and an initial pressure reached at the end of the heating up phase and for a first period of time in a gas atmosphere containing a hydrocarbon during an enrichment phase following directly upon the heating phase;

c) Cooling the workpieces from the first temperature to a second temperature under a vacuum or a gas atmosphere containing chiefly nitrogen (N2) during a first cooling phase following immediately upon the enrichment phase;

d) Boriding the workpieces at the second temperature reached at the end of the first cooling phase and at a second pressure for a second period of time in a gas atmosphere containing boron (B) during a boriding phase following directly upon the first cooling phase;

e) Cooling the workpieces from the second temperature to a third temperature under a vacuum or in a gas atmosphere containing mainly nitrogen (N2) during a second cooling phase following directly upon the boriding phase and f) Quenching the workpieces from the third temperature to a temperature below 150° C. during a quenching phase following upon the second cooling phase.

Such a process is based upon the knowledge that the boriding phase can be used in order to allow the carbon which accumulated upon the edge layer of the workpiece during the enrichment phase to diffuse into the interior of the workpieces. An independent diffusion phase for generating the desired carbon content in the edge layer, as is customary with conventional carburizing, consequently becomes dispensable. A carbonitriding process, if in addition nitrogen is also added in the gas atmosphere, can also be understood as carburization in the sense mentioned above.

The fact that the temperature difference to be bridged during the first cooling phase immediately following upon the enrichment phase is generally small moreover contributes to an efficient process control. For the second temperature necessary for boriding is probably not smaller, or only slightly smaller than the first temperature necessary for the enrichment phase for most carbon-poor ferrous products, such as, for example, case hardening steel C 15. Depending on the application, the second temperature can also be greater than the first temperature so that the workpieces in this case are not to be cooled, but to be heated.

The carbon profile in the edge layer of the workpieces generated during the enrichment phase and the boriding phase serving as a diffusion phase for carbon leads, together with the subsequent quenching, to residual compressive stresses in the edge layer of the workpieces and therewith to a fatigue limit and fatigue strength, which withstands comparatively high dynamic stresses. In addition to this, the wear and tear-resistant boride layer formed during the boriding phase on the surface of the workpieces by the subsequent quenching of the workpieces has a higher load carrying capacity. For the configuration of the carburized and hardened workpieces existing beneath the boride layer possesses a sufficiently high hardness of typically ca. 800 HV which in this way forms a load-carrying sub-structure for the boride layer having as a rule a hardness according to Vickers of ca. 2000. Contrary to a CVD process or a PVD process (physical vapor deposition), the danger of a splitting off of the hard boride layer in connection with dynamic stress is consequently ruled out.

The first temperature to which the workpieces are heated during the heating up phase and at which the workpieces are carburized or carbonitrided during the enrichment phase, the second temperature to which the workpieces are exposed during the boriding phase, the third temperature from which the workpieces are quenched, the length of the first period of time, the length of the second period of time and the amounts of carbon and boron- dispensing mediums introduced during the enrichment phase and the boriding phase are chiefly oriented toward the material of the workpiece that are supposed to be treated, the specific composition of the gas atmosphere necessary for attaining the desired carbon content in the edge layer of the workpieces and the sought treatment success, possibly the desired carburization depth and thickness of the boride layer. The process parameters, which depend upon the material properties of the workpieces to be processed, can be gathered for a certain material from generally accessible data bases such as perhaps Calphad (Calculation of Phase Diagrams). Depending on each application, it can be necessary after this to heat the workpieces during the first and/or second cooling phase to the second or third temperature. Cooling in the aforementioned sense can therefore also represent a warming process.

The objects of the dependent claims represent advantageous embodiments of the method of the invention.

Hence it is advantageous to heat the workpieces to a first temperature between 800° C. and 1100° C. suited for carburizing or carbonitriding commercially available ferrous products during the heating up phase. It is furthermore advantageous to cool the workpieces to a second temperature between 800° C. and 950° C. during the first cooling phase in order to maintain a temperature usable for boriding the workpieces. It is moreover advantageous to cool the workpieces to a third temperature between 800° C. and 900° C. during the second cooling phase in order to attain a hardening temperature corresponding to the respective material. Preferably the materials are cooled to room temperature during the quenching phase so that they can subsequently processed further without delay.

An especially advantageous type of process moreover results when the first period of time amounts to between 60 min. and 360 min. and the second period to between 30 min. and 360 min. The first and second periods of time are appropriately selected as a function of the temperatures prevailing at any given time such that a boride layer with a thickness from 10 μm to 100 μm arises and the edge carbon content directly beneath the boride layer is between 0.6% by weight and 0.9% by weight of a hardening depth of between 0.2 mm and 2.0 mm.

In accordance with an advantageous embodiment of the process of the invention, a support by a plasma, i.e. a strong current glow discharge, takes place during the enrichment phase and/or during the boriding phase. Such a plasma-activated process is described in connection with boriding, for example, by H.-J. Hunger et al. in the article "Plasma-activated gas boriding with boron trifluoride," HTM 52 (1997) 1. Supporting by a plasma as a rule takes place at low pressure and offers in comparison to a purely thermal activation the advantage of a low consumption of carbon or boron- dispensing mediums. Appropriately the gas atmosphere contains boron trichloride ($BCl_3$) and/or boron trifluoride ($BF_3$) and/or diborane ($B_2H_6$) during the boriding phase. Above all, the use of boron trifluoride as a boron- dispensing medium has proven advantageous for plasma-activated boriding. For first of all, a thermal activation is omitted during boriding with boron trifluoride so that the boriding process is restricted to the workpieces situated in the region of the cathode fall, and a boriding on the internal walls of a boriding chamber is avoided. Second, boron trifluoride exists in the form of a gas already at room temperature so that a vaporizer can be economically foregone.

Furthermore, it is appropriate if the workpieces are quenched during the quenching phase at a third pressure, preferably a high pressure of more than 1,013.25 mbar in a reducing or neutral gas atmosphere or in a liquid quenching medium in order to assure a sufficient rate of cooling. The workpieces hardened in this manner can subsequently (as known from case hardening) be tempered at a temperature between 150° C. and 200° C. in a separate furnace.

An especially advantageous embodiment furthermore exists when the workpieces are made of a carbon-poor ferrous product, preferably a case hardening steel according to DIN 17,210. Contrary to the state of the art, the method of the invention is not restricted to ferrous products, which initially already possess a relatively high carbon content, such as, for example, customary heat treatable steels Ck 45, Ck 60 or 42 CrMo 4. It is rather possible with the method of the invention to boride carbon-poor ferrous products, such as, for example, common case hardened steels Ck 10, Ck 15 or 20 MoCr 4. The reason for this is that the enrichment phase performed before the boriding phase makes an enrichment of the edge layer of the workpieces with carbon possible, which allows a carbon content that is sufficient with respect to the required carburization to remain in the edge layer after completion of the boriding phase and therewith of the diffusion phase.

In a preferred embodiment of the method of the invention, the initial pressure as well as the second pressure are between 0.1 mbar and 30 mbar. The pressure here primarily depends on the temperature prevailing at any given time and the respective composition of the gas atmosphere. Thus, for example, the initial pressure should be set such during the enrichment phase that, on the one hand, a comparatively rapid carburizing of the edge layer of the workpieces is attained and on the other, the generally undesired carbide or soot formation on the surface of the workpieces is avoided. The initial pressure and the second pressure need not be equal during the enrichment phase and the boriding phase and also need not necessarily be constant. They can rather be selectively varied, for example pulsed, in accordance with the desired treatment result.

Moreover, a device for implementing the method previously described is proposed for accomplishing the above-mentioned objective, containing at least one treatment chamber in which the heating up phase, the enrichment phase, the first cooling phase, the boriding phase, the second cooling phase and the quenching phase can be conducted one after the other.

Such a device can be a one-chamber vacuum furnace in the simplest case, in which the operations described above can be conducted successively and without transport of the charge.

A preferred configuration of such a device provides two treatment chambers, whereby in the first treatment chamber the heating phase, the enrichment phase, the first cooling phase, the boriding phase and the second cooling phase are conducted and whereby the quenching phase is conducted in the second treatment chamber. Since a separate treatment chamber is available for the quenching phase, a high pressure gas quenching process can be conducted in a simple manner, by means of which comparatively high quenching rates are obtained.

With respect to a higher throughput, a second preferred configuration of the device of the invention provides three treatment chambers, whereby the heating phase and the enrichment phase are conducted in the first treatment chamber, whereby the first cooling phase, the boriding phase and the second cooling phase are conducted in the second treatment chamber, and whereby the quenching phase is conducted in the third treatment chamber.

A third preferred configuration of the device of the invention provides treatment chambers arranged in series or parallel, whereby the heating phase is conducted in the first treatment chamber, whereby the enrichment phase or the enrichment phase and the first cooling phase are conducted in the second chamber, whereby the first cooling phase, the boriding phase and the second cooling phase or the boriding phase and the second cooling phase are conducted in the third treatment chamber and whereby the quenching phase is conducted in the fourth treatment chamber.

A fourth preferred configuration of the device of the invention provides six treatment chambers which are arranged in series or parallel, whereby the first treatment chamber is constructed as a heating chamber for conducting the heating phase, the second treatment chamber is constructed as an enrichment chamber for conducting the enrichment phase, the third treatment chamber is constructed as a cooling chamber for conducting the first cooling phase, the fourth treatment chamber is conducted as a boriding chamber for conducting the boriding phase, the fifth treatment chamber is constructed as a cooling chamber for conducting the second cooling phase, and the sixth treatment chamber is constructed as a quenching chamber for conducting the quenching phase. Since an independent treatment chamber is available for each operation, such a heat-treatment facility is distinguished by a comparatively easy to control process with an especially high throughput.

Finally, a workpiece is proposed, which is made of a metal material and is heat treated by the method of the invention, whereby the workpiece is provided with an outer iron boride layer from 10 μm to 100 μm thick and a case hardening layer under the iron boride. layer with a hardness according to Vickers between 600 and 900 and a case hardening,depth between 0.2 mm and 2.0 mm.

BRIEF DESCRIPTION OF THE DRAWINGS

Details and further advantages of the method of the invention and the corresponding device result from the following description of preferred embodiments. Depicted in particular in the associated drawings are.

DETAILED DESCRIPTION

Figure 1:
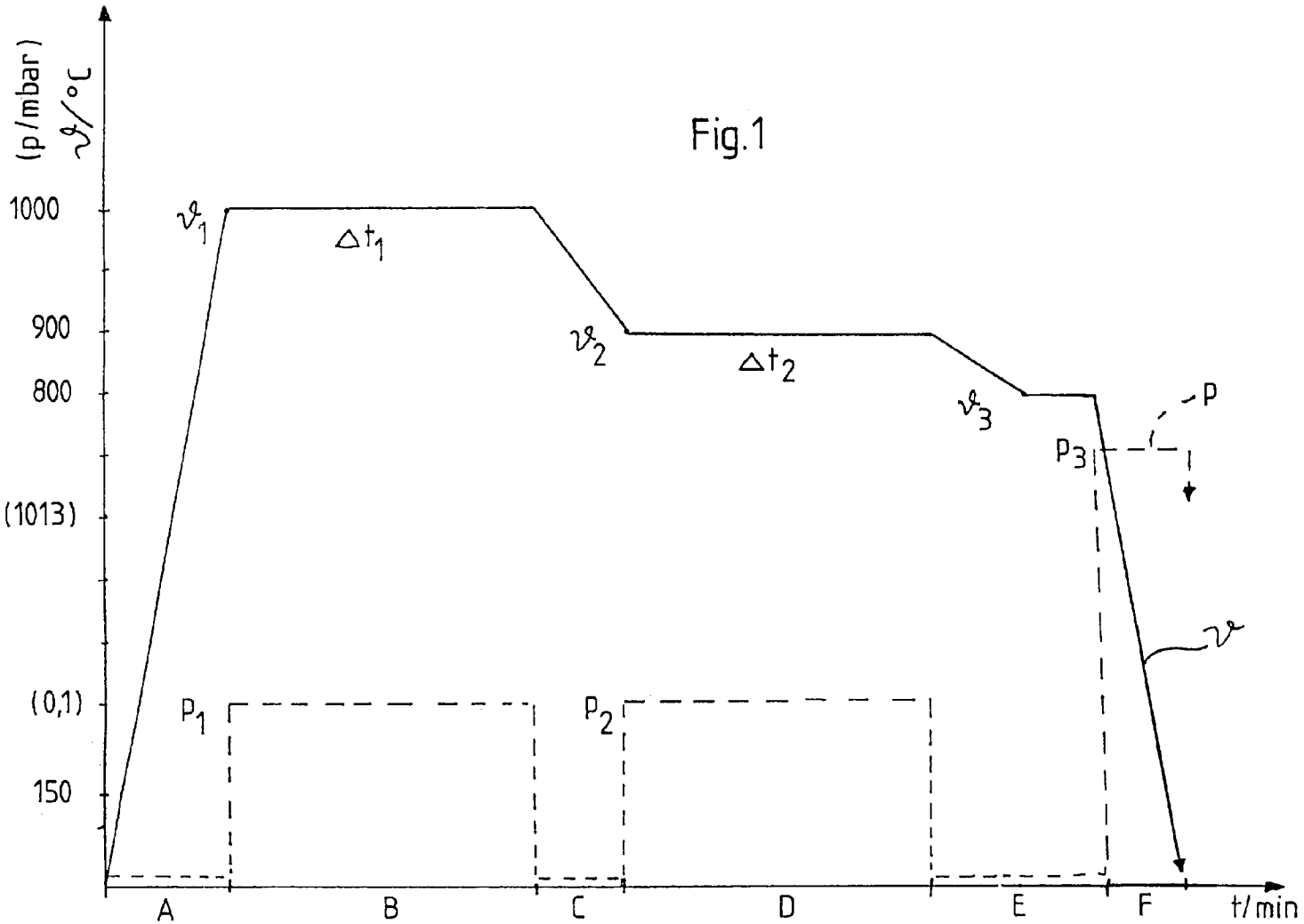
FIG. 1 A diagram illustrating the temperature and pressure curves of the method of the invention over time.

With the diagram represented in FIG. 1, time t is represented on the abscissa and temperature $\phi$ and pressure p are represented on the ordinate. The heat treatment method illustrated on the basis of FIG. 1 is a duplex process in the sense mentioned at the beginning and serves the combined carburizing, boriding and hardening of workpieces, which are made of a carbon-poor iron material, for example case hardened steel C 15 (material 1.0401). The entire process sequence can be subdivided into six phases A to F.

Figure 5:
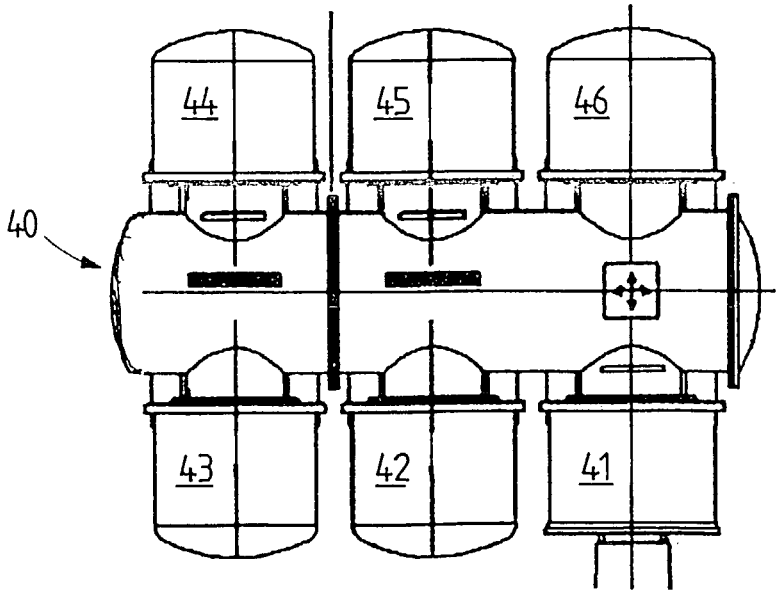
FIG. 5 A schematic representation of a heat treatment facility with six treatment chambers and FIG. 6 A schematic representation of a three-chamber vacuum furnace with gas quenching and flushing sluices.
Figure 6:
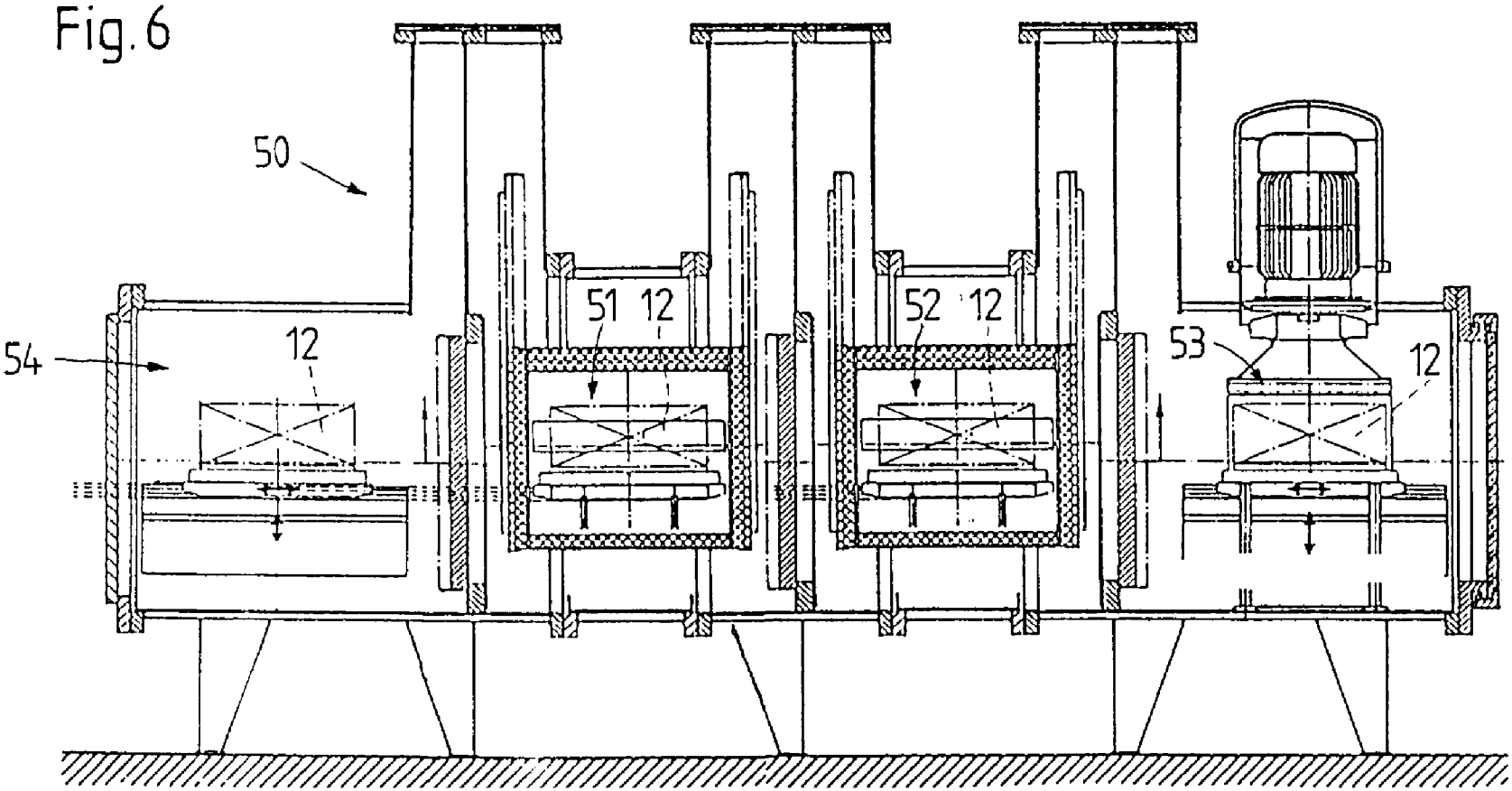

During the first phase, the heating phase A, the workpieces to be processed are heated to a first temperature $\phi_1$ of about 1000° C. The device used for this purpose, possibly a heat treating system in accordance with FIG. 5, is first evacuated after introducing the workpieces and subsequently heated to temperature $\phi_1$. Alternatively, the workpieces can be heated in an inert or a reducing gas atmosphere, possibly of nitrogen ($N_2$), up to temperature $\phi_1$.

After heating them up to the temperature $\phi_1$, the workpieces are transported into a second treatment chamber where they are exposed to a gas atmosphere containing a hydrocarbon during a second phase directly following upon the first phase, the enrichment phase B, for a first period of time $\Delta t_1$, which amounts to between 60 min and 360 min according to the required carburizing depth. The amount of the pressure $p_1$ prevailing during the enrichment phase is basically directed according to the desired treatment result as well as the type of hydrocarbon used and amounts to ca. 10 mbar in the present case. The enrichment phase B can be plasma-activated if need be.

Subsequent to the enrichment phase B, the workpieces are conveyed to a third treatment chamber where they are cooled from temperature $\phi_1$ to a second temperature $\phi_2$ of ca. 900° C. under a vacuum during a first cooling phase C directly following upon the enrichment phase B. Alternatively the workpieces can be cooled in a primarily nitrogen-containing and therewith inert gas atmosphere to temperature $\phi_2$. the end of cooling phase C, the workpieces are transported to a fourth treatment chamber and borided at temperature $\phi_2$ and a second pressure $p_2$ of ca. 0.1 mbar for a second period of time $\Delta t_2$ in a boron-containing gas atmosphere. During boriding, the carbon deposited during enrichment phase B on the edge layer of the workpieces diffuses into the interior of the workpieces so that the boriding phase D at the same time represents a diffusion phase for the carburizing process. The period of time $\Delta t_2$ for this boriding phase D immediately following upon cooling phase C is between 30 min and 360 min according to the desired treatment result. The gas atmosphere contains boron trichloride, boron trifluoride, diborane or several of the previously named substances as boron- dispensing mediums during boriding phase D. If need be, the boriding phase D can be plasma-activated. The use of boron trifluoride as a boron-dispensing medium is especially suited for this case.

A second cooling phase E follows directly upon the boriding phase D during which the workpieces are cooled from temperature $\phi_2$ to a third temperature $\phi_3$ of ca. 800° C. under a vacuum or alternatively in an inert gas atmosphere in a fifth treatment chamber of the heat-treating system. For the purpose of balancing the temperature within the batch, the workpieces are maintained at a third temperature $\phi_3$ for ca. 15 min to 30 min, as can be recognized in FIG. 1.

Finally, the workpieces are quenched during a quenching phase F directly following upon the second cooling phase E from quenching temperature $\phi_3$ to a temperature of less than 150°□ C., for example room temperature. For this, the workpieces are transported into a sixth treatment chamber and cooled at a high pressure $p_3$ from more than 1,013.25 mbar in a reducing or neutral gas atmosphere. Alternatively, the workpieces can also be quenched in a liquid quenching medium.

Figure 2:
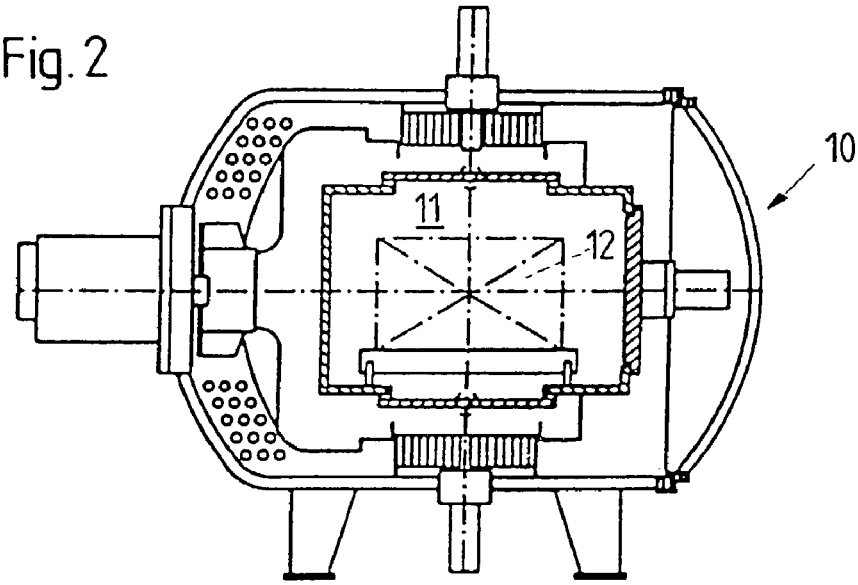
FIG. 2 A schematic representation of a one-chamber vacuum furnace with gas quenching.

Various embodiments of a device are shown in FIG. 2 through 6 in which the previously described method can be implemented. The device according to FIG. 2 is a one-chamber vacuum furnace 10 in which all operations A to F are conducted in one and the same treatment chamber 11. The workpieces assembled into a batch 12 are here quenched by gas during quenching phase F.

Figure 3:
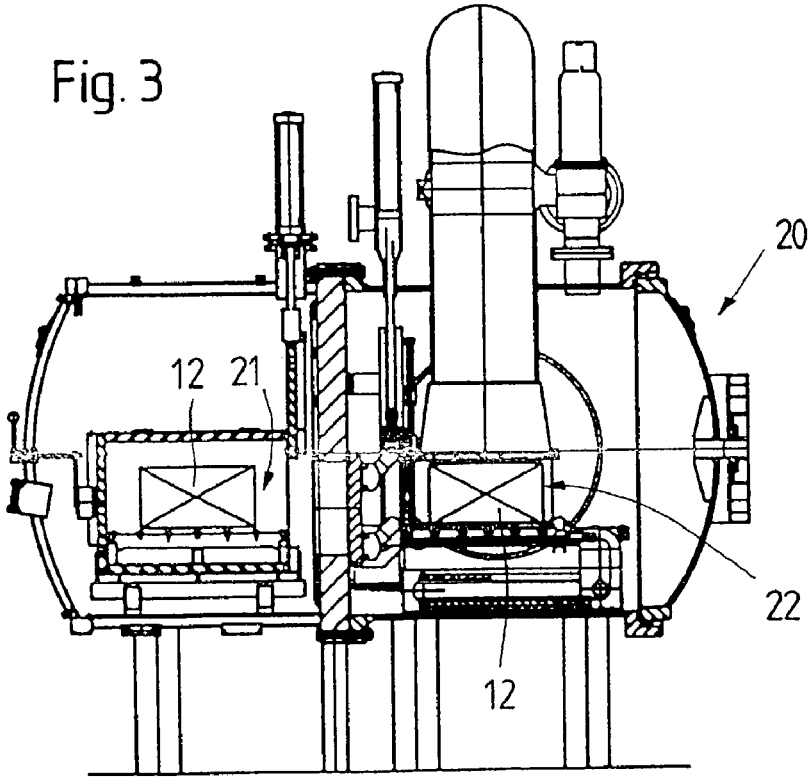
FIG. 3 A schematic representation of a two-chamber vacuum furnace with gas quenching.
Figure 4:
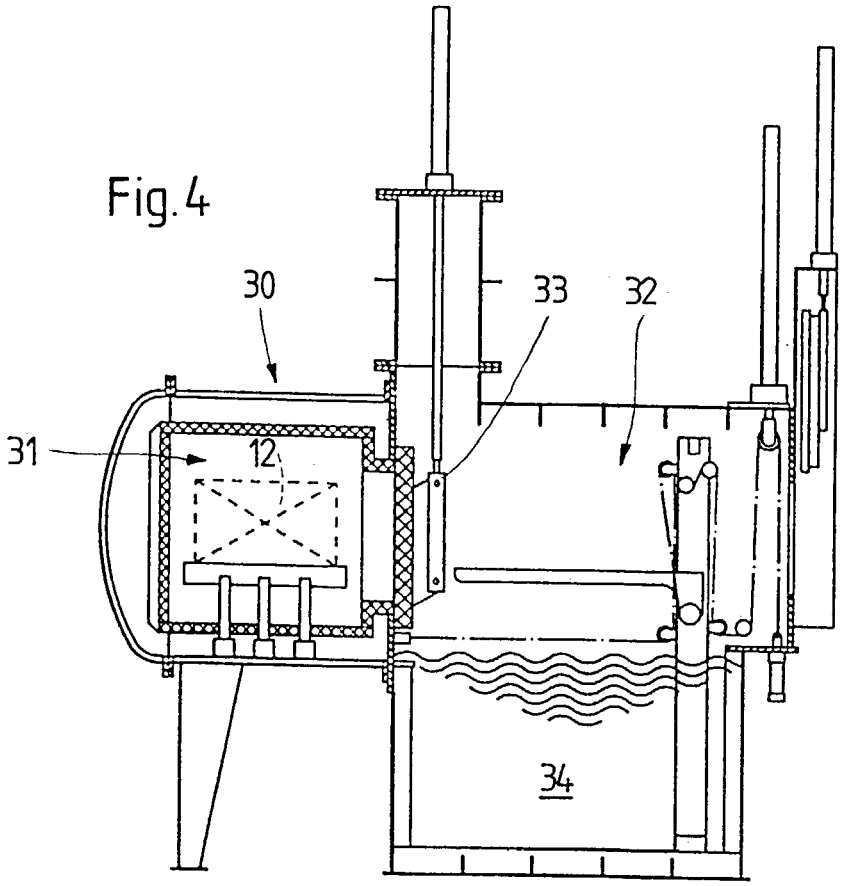
FIG. 4 A schematic representation of a two-chamber vacuum furnace with oil quenching.

In contrast, the device represented in FIG. 3 is a two-chamber vacuum furnace 20, which has a first treatment chamber 21 and a second treatment chamber 22. Processing steps A to E are conducted in the first treatment chamber 21, while the second treatment chamber constructed as a gas quenching chamber serves for quenching the batch 12 during the quenching phase F. A two-chamber vacuum furnace 30 shown in FIG. 4 differs from the device in accordance with FIG. 3 mainly in that an oil bath 34 is present in a second treatment chamber 32, which is separated from the first treatment chamber 31 by a door 33, in which the batch 12 is quenched during quenching phase F. Operations A to E are conducted analogously to the device in accordance with FIG. 3 in the first treatment chamber 31.

A heat treating system 40 is depicted in FIG. 5 which is provided with six treatment chambers 41 to 46 arranged parallel. Treatment chamber 41 serves as a flushing sluice when the batch 12 enters into the heat treatment system 40 and as a high pressure quenching chamber during quenching phase F at the end of the treatment cycle. Treatment chamber 42 is constructed as a heating chamber in which the batch 12 is heated during the heating phase A to the first temperature $\phi_1$. The batch 12 is carburized during enrichment phase B in the treatment chamber 43. Cooling of the batch 12 to the second temperature $\phi_2$ takes place in the treatment chamber 44 during the first cooling phase C. Boriding of the batch 12 takes place during boriding phase D in the treatment chamber 45, while the treatment chamber 46 is provided for cooling and equalizing the batch 12 to the third temperature $\phi_3$ during the second cooling phase E. A three-chamber vacuum furnace 50 can be recognized in FIG. 6. Apart from three treatment chambers 51 through 53 arranged behind one another, the vacuum furnace 50 contains a flushing sluice 54, through which the batch 12 is introduced into the vacuum furnace 50. The treatment chamber 51 serves the purpose of warming the workpieces to the first temperature $\phi$1 during the heating phase A and for carburizing the batch 12 during the enrichment phase B. In the treatment chamber 52, the cooling to the second temperature $\phi$2 occurs during the first cooling phase C, the boriding of the batch 12 during the boriding phase D and the cooling and equalizing of the batch 12 to the third temperature $\phi$3 during the second cooling phase E. Treatment chamber 53 is provided for a concluding gas quenching during quenching phase F.

The workpieces treated using the method described above have an outer iron boride layer from 10 μm to 100 μm thick and a case hardening layer lying under the iron boride layer with a Vickers hardness between 600 and 900 and a case hardening depth between 0.2 mm and 2.0 mm. They are distinguished by a comparatively great fatigue limit and fatigue strength with simultaneous wear and tear resistance. The reason for this is the combination of carburizing, boriding and hardening obtained through operations A to F. Synergy effects thus arise through operations A to F, which directly follow upon one another and allow for an efficient process control. This is true because the process can be conduced in a single cycle and in a single heat treatment system without interruption owing to which significant economic advantages can be obtained in comparison with the previously usually separate carburizing, cooling, boriding and hardening processes.

The invention claimed is:

1. Process for heat treating metal workpieces, the method comprising:

heating the workpieces to a first temperature under a vacuum or a neutral or reducing gas atmosphere during a heating phase;

carburizing the workpieces at the first temperature and at a first pressure reached at the end of the heating phase and for a first period of time in a gas atmosphere containing a hydrocarbon during an enrichment phase following directly upon the heating up phase;

transitioning the workpieces from the first temperature to a second temperature below or greater the first temperature under a vacuum or a gas atmosphere containing chiefly nitrogen during a first temperature transition phase following immediately upon the enrichment phase;

boriding the workpieces at the second temperature and at a second pressure reached at the end of the first temperature transition phase for a second period of time in a gas atmosphere containing boron during a boriding phase following directly upon the first temperature transition phase, wherein the gas atmosphere during the boriding phase contains at least one of boron trichloride and boron trifluoride and diborane;

transitioning the workpieces from the second temperature to a third temperature below or greater the second temperature under a vacuum or in a gas atmosphere containing mainly nitrogen during a second temperature transition phase following directly upon the boriding phase; and quenching the workpieces from the third temperature to a temperature below 150° C. during a quenching phase following upon the second temperature transition phase;

such that the process creates an edge layer on the workpiece comprising an outer iron boride layer and a case hardening layer beneath the iron boride layer.

2. Method according to claim 1, wherein the workpieces are heated to a first temperature between 800° C. and 1100° C. during the heating phase.

3. Method according to claim 1, wherein the workpieces are transitioned during the first temperature transition phase to a second temperature between 800° C. and 950° C.

4. Method according to claim 1, wherein the workpieces are transitioned to a third temperature between 800° C. and 900° C. during the second temperature transition phase.

5. Method according to claim 1, wherein the workpieces are cooled to room temperature during the quenching phase.

6. Method according to claim 1, wherein the first period of time is between 60 minutes and 360 minutes.

7. Method according to claim 1, wherein the second period of time is between 30 minutes and 360 minutes.

8. Method according to claim 1, further comprising a support by a plasma during at least one of the enrichment phase and the bonding phase.

9. Method according to claim 1, wherein the workpieces are quenched during the quenching phase at a third pressure, in a reducing or neutral gas atmosphere or in a fluid quenching medium.

10. Method according to claim 1, wherein the workpieces are made of a carbon-poor ferrous product.

11. Method according to claim 1, wherein a first pressure is between 0.1 mbar and 30 mbar.

12. Method according to claim 1, wherein a second pressure is between 0.1 mbar and 30 mbar.

* * * * *